US005639303A

United States Patent [19]

Plomer

[11] Patent Number: 5,639,303

[45] Date of Patent: Jun. 17, 1997

[54] APPARATUS FOR THE APPLICATION ON BOTH SIDES OF A LIQUID MEDIUM ONTO A MOVING MATERIAL WEB, IN PARTICULAR OF PAPER OR CARDBOARD

[75] Inventor: Anton Plomer, Heidenheim, Germany

[73] Assignee: Voith Sulzer Papiermaschinen GmbH, Hedenheim, Germany

[21] Appl. No.: 438,653

[22] Filed: May 9, 1995

[30] Foreign Application Priority Data

May 9, 1994 [DE] Germany ..... 44 16 399.1

[51] Int. Cl.[6] ..... B05C 1/10

[52] U.S. Cl. ..... 118/218; 118/224

[58] Field of Search ..... 118/218, 223, 118/224, 244, 257, 258; 226/97; 34/611, 618, 620, 623, 664, 665

[56] References Cited

U.S. PATENT DOCUMENTS

| | | | |
|---|---|---|---|
| 3,496,648 | 2/1970 | Hering | 34/644 |
| 4,774,107 | 9/1988 | Von Kwiatkowski et al. | 118/216 |
| 5,230,165 | 7/1993 | Beisswanger | 34/60 |
| 5,401,314 | 3/1995 | Kustermann | 118/227 |

FOREIGN PATENT DOCUMENTS 4029487 9/1990 Germany .

*Primary Examiner*—Donald E. Czaja
*Assistant Examiner*—Calvin Padgett
*Attorney, Agent, or Firm*—Sughrue, Mion, Zinn, Macpeak & Seas

[57] ABSTRACT

An apparatus for application on both sides of a liquid medium onto a moving material web, in particular of paper or cardboard, including an application (2) through which the material web (1) runs essentially from above to below with reference to a horizontal plane and in which the material web is treated on both sides with a liquid medium, and a dryer and deflector which are arranged beyond the applicator and in which the material web provided on both sides with liquid medium is dried and further transported, wherein the dryer and the deflector are connected to the applicator along the passage of the material web (1) in such a manner that, firstly a first contactlessly operating deflector (3) for deflecting the material web into an essentially horizontal direction is provided and beyond which there is arranged a first dryer (5) for drying the upper side of the material web and which is followed by a second contactlessly operating deflector (4) for deflecting the material web into a direction from below to above with respect to a horizontal plane and to which in turn there is connected a second dryer (6) for drying the lower side of the material web.

9 Claims, 3 Drawing Sheets

APPARATUS FOR THE APPLICATION ON BOTH SIDES OF A LIQUID MEDIUM ONTO A MOVING MATERIAL WEB, IN PARTICULAR OF PAPER OR CARDBOARD

BACKGROUND OF THE INVENTION

The invention relates to an apparatus for the application on both sides of a liquid medium onto a moving material web, in particular of paper or cardboard, including an application means through which the material web passes essentially from above to below with respect to a horizontal plane and in which a material web is treated on both sides with a liquid medium, and a drying means and a deflection means which are arranged downstream of the application means and at which the material web provided on both sides with liquid medium is dried and further transported.

In an apparatus of this kind, a material web, consisting for example of paper, cardboard or a textile material is provided on both sides with a liquid medium such as starch, an impregnating liquid or dye pigments, and subsequently at least pre-dried. In conventional apparatus of this kind, there exists the problem that the guidance of the material web beyond the application means either takes up a large amount of space in the longitudinal direction of the machine or that the material web is guided down into the machine cellar, i.e. an area beneath the base of the machine where the material web is accessible only with great difficulty.

The present invention is therefore based on the problem of providing an apparatus of the type initially described in which a compact type of construction is realized.

SUMMARY OF THE INVENTION

In the solution according to the invention, a first contactlessly operating deflection means for deflecting the material web into a substantially horizontal direction is directly connected to the application means. By means of this deflection immediately beyond the application means, the material web is maintained in its passage above the machine base and a material web guidance down into the machine cellar is avoided. In accordance with the invention, there is then connected to this a first drying means for drying the upper side of the material. Thus, also the first drying means installed mainly above the material web is arranged above the machine bed. If an electrically heated infrared radiator is used as a drying means, the radiator of which is arranged above the material web and the reflector of which is arranged beneath the material web, the risk of fire in case of a web break is also reduced in the inventive arrangement because the material web can then fall only onto the reflector. In accordance with the invention, there is then connected with this a second contactlessly operating deflection means for deflecting the material web in a direction from below to above with reference to a horizontal plane. On account of this measure, the material web is again conveyed upwards, namely away from the machine bed so that the adjoining second drying means for the lower side of the material web is arranged above the second deflection means in accordance with the invention. Consequently, the entire section of the unit described above and connected in series beyond the application means is located above the machine bed and provides a very compact type of construction in the longitudinal direction of the machine without the disadvantage of a material web guidance through the machine cellar.

The material web is preferably deflected by a second deflection means into a vertically upward direction. This results in a particularly space-saving arrangement in the longitudinal direction of the machine.

In a preferred embodiment, the drying means operates without contact. This results in the advantage that the material web beyond the application means is guided contactlessly by both deflection means and both drying means, i.e. the material web is not contacted by these means. This results in the quality of the coating of the liquid medium on both sides of the material web being wholly maintained without the occurrence of lines or markings in the applied liquid medium.

An air cushion of warm air is preferably formed in the contactlessly operating deflection means. Thus, the deflection means already contribute to drying the material web onto which the liquid medium is applied. It is particularly useful in connection with the above-described contactlessly operating drying means to supply the exhaust air of the first drying means arranged between both the deflection means to both contactlessly operating deflection means as warm air for formation of the air cushions. In this matter, the exhaust air of the drying means, for example the heated cooling air of infrared radiators, is advantageously used as blast air for the deflection means. The heat energy in the exhaust air of the first drying means therefore contributes to a quicker drying of the material web.

A useful embodiment of the invention consists in providing a roof-like cover over both deflection means as well as the first drying means. On the one hand, such a covering leads to better heat insulation in the covered area so that the heat is more favorably held in the region directly above the material web to dry this more quickly. On the other hand, the cover also serves as a protection against splashes of liquid medium or cleaning agent which drops or splashes from the application mechanism or when it is cleaned.

In a useful embodiment of the invention, a third contactlessly operating deflection means is provided beyond the second drying means which deflects the material web about 90° to 180° in a direction leading away from the application means. A further inventive apparatus with an application means and deflection and drying means arranged beyond this can then be connected again in an advantageous manner directly beyond such a third deflection means in order to provide the material web on both sides with a further film of a liquid medium. This also results with such a variant in a particularly spaced-saving arrangement in the longitudinal direction of the machine for a unit in which each side of the material web is coated with two successive films. Naturally, such a second application means can also be formed in a different manner than the inventive apparatus previously described. For example, only one side of the web may be additionally coated in the second application means. In any case, the advantage still results that the material web is guided contactlessly during its entire passage from the first application means of the previously described inventive apparatus until entry into a second application means connected downstream of this.

Another useful embodiment of the invention consists in providing a third contactlessly operating deflection means after the second drying means which deflects the material web about at least 180° in a direction from above to below with reference to the horizontal plane. Such a third deflection means therefore has an angle of contact of the material web about the deflection means of at least 180°.

In a useful variant, arranged in series with the third deflection means with an angle of contact of at least 180° is a fourth contactlessly operating deflection means which deflects the material web in a direction from below to above with reference to a horizontal plane, and a web drive roll, which deflects the material web in a direction from above to below with reference to a horizontal plane and away from the application means. A second apparatus according to the invention with a second application means can be directly connected after this in order to apply a further liquid medium onto both sides of the material web. Naturally, a different second application means can be connected, for example, to only provide one side of the material web with a further liquid medium.

In another advantageous variant, there is connected to the third deflection means, having an angle of contact of at least 180°, a fourth contactlessly operating deflection means which deflects the material web by at least 180° in a direction from below to above with reference to a horizontal plane, and two drying cylinders are then connected beyond this fourth deflection means which respectively effect a deflection of the material web about at least 180° and in a manner such that the material web subsequently runs from below to above with reference to a horizontal plane. In this variant, after passing the second drying means, the material web is always alternatively guided from below to above and from above to below over the two contactlessly operating deflection means and the two drying cylinders. In this case, the angle of contact of the material web about the deflection means and the drying cylinders is respectively at least 180°. An especially space-saving arrangement is realized above all in the longitudinal direction of the machine particularly when the angle of contact is selected to be greater than 180°. When the first and second drying means of the apparatus advantageously operate in a contactlessly manner, the material web in this variant runs contactlessly from the application means to the first drying cylinder.

BRIEF DESCRIPTION OF THE DRAWINGS

The apparatus according to the invention is described in more detail in the following by war of exemplary embodiments with reference to the drawings, in which.

DETAILED DESCRIPTION OF THE INVENTION

Figure 1:
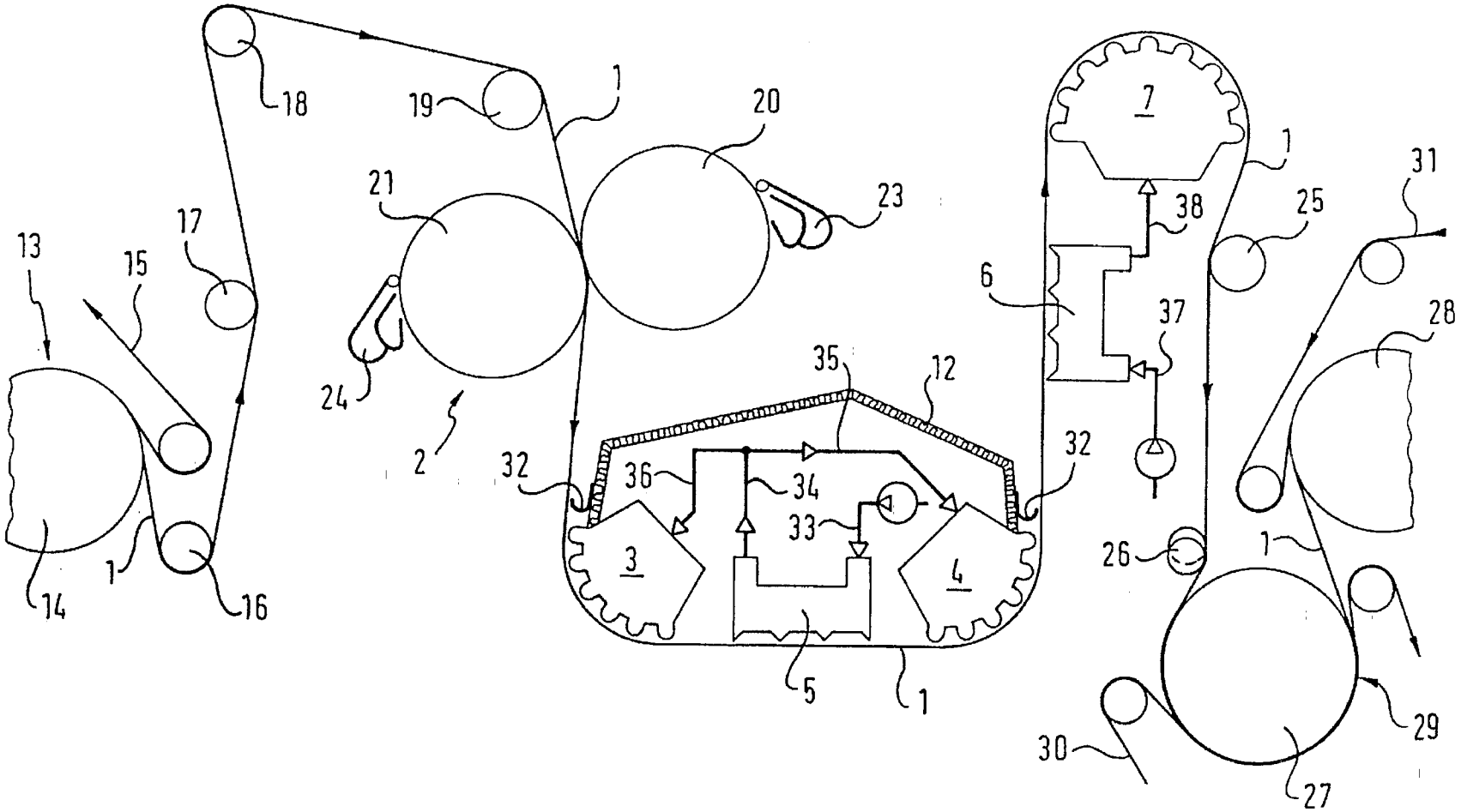
FIG. 1 shows a schematic side view of a section of a whole unit with a first embodiment of the inventive apparatus.

In the section of a whole unit shown in FIG. 1, a material web 1 is initially led out of a contact drying cylinder arrangement 13. In this contact drying cylinder arrangement the material web is pressed by a so-called top felt 15 in a known manner against a number of drying cylinders 14. The material web is then introduced via web guiding rolls 16, 17, 18 and 19 into a press nip which is formed between two rolls 20, 21 of an application means 2. In the application means 2, liquid medium is applied in a known manner by respectively one application mechanism 23, 24 onto each of the two rolls 20, 21. The liquid medium is then taken up in the press nip by both sides of the material web from the rolls 20, 21 acting as application rolls.

After passing the application means 2 in a path from above to below, the material web 1 is first deflected into an approximately horizontal direction by a contactlessly operating deflection means 3. After this, the material web 1 passes with its upper side beneath an infrared radiator 5 and is subsequently led further vertically upwardly after being deflected by means of a contactlessly operating deflection means 4. The material web 1 passes an infrared radiator 6 with its lower side and is then deflected by a contactlessly operating deflection means 7 about somewhat more than 180° in a direction from above to below.

The material web 1 is then supplied via a web guide roll 25 and a so-called width tightening roll 26 to a contact drying cylinder arrangement 29 which corresponds in terms of its basic structure to the first contact drying cylinder arrangement 13.

During this, the material web is pressed by means of a bottom felt 30 against a drying cylinder 27 as well as further drying cylinders, which are not shown, and subsequently pressed by a top felt 31 against a drying cylinder 28 as well as further drying cylinders, which are not shown.

The deflection means 3 and 4 and the infrared radiator 5 are covered by a roof 12. Collecting troughs 32 are arranged on the lower ends of the roof 12. This roof 12 protects the devices located beneath it from liquid medium or cleaning agent which drops or splashes down from the application means during operation or during cleaning. These liquids are then collected in the collecting troughs 32 and led away. Additionally, the roof 12 also acts as a heat insulation and better maintains the heat emitted from the means 3, 4 and 5 in this area of the unit, this heat then being used to further improve the drying process of the passing material web.

The contactlessly operating deflection means 3 and 4 respectively form an air cushion upon which the material web 1 glides. As indicated schematically in FIG. 1 in an arrow diagram, cooling air is supplied to the infrared radiator 5 by means of a supply line 33 and is then removed via a line 34 as warm exhaust air and supplied via distribution lines 35, 36 to both deflection means 3 and 4. This warm exhaust air from the infrared radiator 5 is then used to form the air cushions in the deflection means 3 and 4. On account of the formation of warm air cushions, the drying process in the area of the deflection means is additionally enhanced.

The infrared radiator 6 is also supplied via a supply line 37 with cooling air which is then fed as warm exhaust air via a line 38 to the contactlessly operating deflection means 7 in order to form a warm air cushion. In this manner, the drying process of the material web 1 is also additionally enhanced during the deflection.

Figure 2:
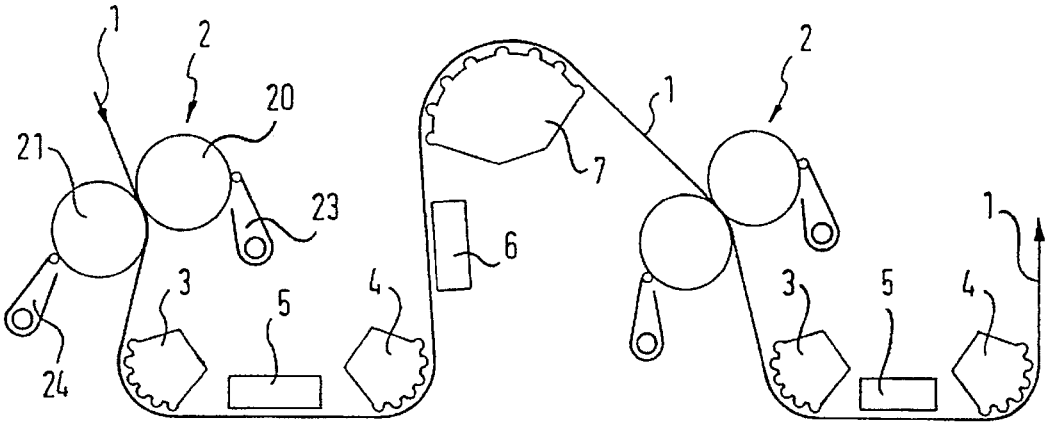
FIG. 2 shows a schematic side view of a section of a whole unit with a second embodiment of the inventive apparatus.

The section illustrated in FIG. 2 of a whole unit according to a second embodiment of the invention corresponds in the section of passage of the material web 1 from the application means 2 to the infrared radiator 6 to the unit previously described with reference to FIG. 1. Therefore, this section in which the components in FIG. 2 are denoted with the same reference signs as in FIG. 1 is not described again. Naturally, a roof for the unit 3, 4 and 5 can be provided also in the embodiment according to FIG. 2 and the warm exhaust air from the infrared radiators 5 and 6 can also be supplied in an advantageous manner to the contactlessly operating deflection means 3, 4 and 7 for formation of warm air cushions.

In the second embodiment according to FIG. 2, a contactlessly operating deflection means 7 is connected with the infrared radiator 6 and deflects the material web 1 from the vertically upwardly extending web running direction about an angle of somewhat more than 90° into a web running direction from above to below which leads away from the first application means 2. The material web is then supplied directly in this running-in direction to a second application means 2. This second application means 2 as well as the adjoining contactlessly operating deflection means 3 and 4 and the infrared radiator 5 arranged therebetween correspond in their arrangement and design to those components which adjoin the first application means 2 and have already been described. An infrared radiator for drying the lower side of the material web as well as further adjoining units as required, which are not shown, are also connected after the deflection means 4 of the second coating station. As shown in FIG. 2, several coating stations can also be arranged in series in a particularly space-saving arrangement.

Figure 3:
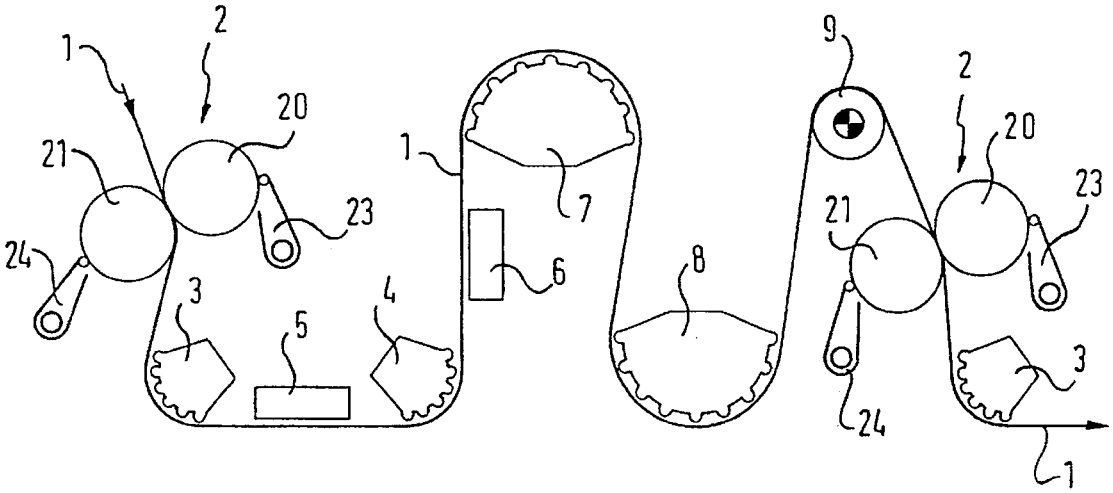
FIG. 3 shows a schematic side view of a section of a whole unit with a third embodiment of the inventive apparatus.

The section illustrated in FIG. 3 of a whole unit according to a third embodiment of the invention corresponds in its first part in which the material web 1 is led from an application means 2 up to a second infrared radiator 6 to the arrangement as shown in FIG. 2, and this section of the unit is therefore not described again. There are connected to the infrared radiator 6 two contactlessly operating deflection means 7 and 8 at which the material web 1 is initially deflected from its vertically upward running direction again into a running direction from above to below and subsequently in a running direction from below to above. The angle of contact about the deflection means 7 in this case corresponds to somewhat more than 180° and the angle of contact at the deflection means 8 amounts to approximately 180°. Subsequently, the material web 1 again runs from above to below over a web drive roll 9 into a second application means 2 which correspond to the first application means 2 and to which are connected deflection and drying units in the same or a similar manner as in the first application means 2.

Figure 4:
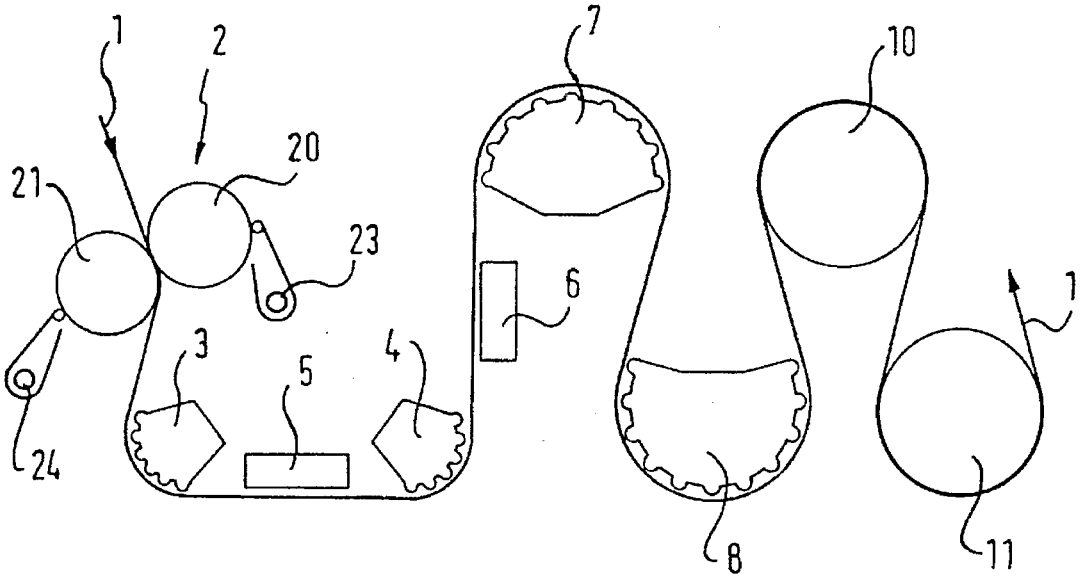
FIG. 4 shows a schematic side view of a section of a whole unit with a fourth embodiment of the inventive apparatus.

The section shown in FIG. 4 of a whole unit according to a fourth embodiment of the invention corresponds in the section of passage of the material web 1 from the first application means 2 to the contactlessly operating means 7 of the unit previously described with reference to FIG. 3 and reference is therefore made in respect of this section of the unit to the previous explanations. After passing the deflection means 7, the material web 1 is led to a further contactlessly operating deflection means 8 at which the angle of contact is more than 180° as in the case of the deflection means 7. The material web 1 subsequently runs over two drying cylinders 10 and 11 at which contact drying takes place. The material web guidance about both drying rolls corresponds to the material web guidance about both the deflection means 7 and 8 so that the material web again runs in a direction from below to above after leaving the drying cylinder 11.

In all four embodiments of the invention described with reference to FIGS. 1 to 4, the material web is therefore guided throughout in a contactless manner from the first application means 2 until after it passes the third deflection means 7. In the third and fourth embodiments according to FIGS. 3 and 4, the contactless material web guidance actually extends up to beyond the fourth deflection means 8.

What is claimed is:

1. An apparatus for application on both sides of a liquid medium onto a moving material web, in particular of paper or cardboard, including an application means (2) through which the material web (1) passes from above to below with reference to a horizontal plane and in which the material web is treated on both sides with a liquid medium, and drying means and deflection means which are arranged beyond the application means and in which the material web provided on both sides with liquid medium is dried and further transported, wherein the drying means and deflection means are connected along the passage of the material web (1) in the following sequence and arrangement:

a first deflection means (3) for deflecting the material web, without contacting the web, into a horizontal direction, a first drying means (5) for drying the upper side of the material web, a second deflection means (4) for deflecting the material web, without contacting the web, into a direction from below to above with reference to a horizontal plane, and a second drying means (6) for drying the lower side of the material web;

wherein a roof-like cover (12) is provided above both of the deflection means (3, 4) as well as the first drying means (5).

2. An apparatus according to claim 1, wherein the second deflection means (4) deflects the material web (1) into a vertical upward direction.

3. An apparatus according to claim 1, wherein the drying means (5, 6) dries the material web without contacting the web.

4. An apparatus according to claim 1, wherein an air cushion of warm air is formed in each of the deflection means (3, 4).

5. An apparatus according to claim 4, wherein the warm air cushions of each of the deflection means (3, 4) are formed from the exhaust air of the first drying means (5).

6. An apparatus according to claim 1, wherein there is provided after the second drying means (6) a third deflection means (7) which deflects the material web (1), without contacting the web, from about 90° to 180° into a direction away from the application means (2).

7. An apparatus according to claim 1, wherein there is provided beyond the second drying means (6) a third deflection means (7) which deflects the material web (1), without contacting the web, at least 180° into a direction from above to below with reference to a horizontal plane.

8. An apparatus according to claim 7, wherein there is arranged beyond the third deflection means (7) a fourth deflection means (8) which deflects the material web (1), without contacting the web, into a direction from below to above with reference to a horizontal plane, and that there is arranged beyond the fourth deflection means (8) a web driving roll (9) which deflects the material web (1) into a direction from above to below with reference to a horizontal plane which leads away from the application means (2).

9. An apparatus according to claim 7, wherein there is arranged beyond the third deflection means (7) a fourth deflection means (8) which deflects the material web (1), without contacting the web, at least 180° into a direction from below to above with reference to a horizontal plane, and that there are arranged beyond the fourth deflection means (8) two drying cylinders (10, 11) each of which effects a deflection of the material web (1) at least 180° such that the material web subsequently runs from below to above with reference to a horizontal plane.

* * * * *